United States Patent [19]

Carter et al.

[11] Patent Number: 4,502,218

[45] Date of Patent: Mar. 5, 1985

[54] BLADE SHARPENER INSERT FOR KNIFE SCABBARD

[75] Inventors: Larry D. Carter, Mosinee; Daniel D. Call, Athens, both of Wis.

[73] Assignee: Oy Fiskars AB, Helsinki, Finland

[21] Appl. No.: 454,466

[22] Filed: Dec. 29, 1982

[51] Int. Cl.[3] ..... B25F 3/00; B26B 11/00; B24D 5/00

[52] U.S. Cl. ..... 30/138; 30/139; 51/214

[58] Field of Search ..... 30/138, 139, 151, 162; 51/214, 204; 224/232

[56] References Cited

U.S. PATENT DOCUMENTS

| | | | |
|---|---|---|---|
| 2,767,530 | 10/1956 | Paldanius | 30/138 |
| 3,676,961 | 7/1972 | Jackson | 51/214 |
| 3,774,350 | 11/1973 | Kingsley | 51/214 |
| 3,861,246 | 1/1975 | Waller | 30/138 |
| 4,091,691 | 4/1978 | Kingsley | 30/138 |
| 4,428,515 | 1/1984 | Mayer | 30/138 |

FOREIGN PATENT DOCUMENTS

| | | | |
|---|---|---|---|
| 39984 | 8/1936 | Netherlands | 30/151 |

*Primary Examiner*—Paul A. Bell
*Assistant Examiner*—Paul M. Heyrana
*Attorney, Agent, or Firm*—James E. Nilles

[57] ABSTRACT

A flexible knife scabbard has a blade-receiving elongated passage open at one end extending longitudinally therein and has a blade sharpening slot open at both ends extending laterally therethrough and transversely through the elongated passage. Knife blade sharpening insert means including a pair of mating rigid plastic insert members or components are disposed in the elongated passage and each component includes an aperture in registry with the other and with the blade sharpening slot. The insert means further includes a pair of cylindrical ceramic blade sharpening elements or rods, one mounted on each insert component and overlying a portion of the associated aperture. The two rods are disposed in V-shaped arrangement relative to each other and located at (and overlapping) an end of the sharpening apertures in the insert member and the sheath slot. The knife blade slips into the scabbard between the insert members in normal use. In a sharpening operation, the knife blade is inserted through the sharpening slot and through the sharpening apertures and moved reciprocably therein so that the blade edge to be sharpened bears or wipes against the sharpening elements. Such movement is repeated until the desired degree of sharpness is attained.

9 Claims, 11 Drawing Figures

BLADE SHARPENER INSERT FOR KNIFE SCABBARD

BACKGROUND OF THE INVENTION

1. Field of Use

This invention relates generally to a blade sharpener insert for a knife scabbard.

2. Description of the Prior Art

Knives used by sportsmen for hunting, fishing and other purposes are typically carried in a scabbard which can be attached to the belt of the user. For best service, it is desirable to sharpen the knife blade before use or as conditions require. Therefore, the user may carry in his pocket, pack or tackle box some type of blade sharpening device, such as a conventional small abrasive stone or two elongated cylindrical ceramic sharpening sticks which are detachably mounted on a base board and storable in a carrying case. Not infrequently, such sharpening devices are not at hand or are difficult or impossible to locate when needed, or even turn out to be lost. As a result, the knife sometimes goes unsharpened and the user is frustrated and upset. In multi-component devices the possibility of component loss and breakage is another problem to consider.

The prior art contains numerous examples of knives and knife scabbards having blade sharpening means thereon or associated therewith and the following patents illustrate the state of the art.

U.S. Pat. No. 2,767,530 (issued 1956) shows a pair of angularly disposed abrasive elements permanently attached to a metal bracket at the top opening of a leather sheath for engagement by the knife blade. U.S. Pat. No. 3,307,756 (issued 1967) shows a rigid knife sheath which has a honing stone covering and secured to the exterior side thereof and available for sharpening the knife. U.S. Pat. No. 3,846,909 (issued 1974) shows a knife sharpener carried by a detachable portion of a knife handle which may be slid along the knife blade to effect sharpening. Other U.S. patents show sharpeners mounted on the knife sheath or in the knife handle and these patents are: U.S. Pat. Nos. 2,791,831 (issued 1957); 2,744,320 (issued 1956); 2,658,272 (issued 1953); 2,651,839 (issued 1953) and 2,416,929 (issued 1947). U.S. Pat. Nos. 4,091,691 (issued 1978); 3,774,350 (issued 1973); 3,676,961 (issued 1972) and 3,861,246 (issued 1975) show a combined storage case and sharpener.

U.S. patent application Ser. No. 371,654 to Paul C. Mayer for "Knife Scabbard with Integral Blade Sharpener", which issued Jan. 31, 1984 as U.S. Pat. No. 4,428,515, and assigned to the same assignee as the present application discloses a rigid plastic belt-mountable scabbard for carrying a sportsman's knife. The scabbard comprises spaced apart rigid side walls defining an elongated passage open at one end for receiving and protecting the blade of a knife carried in the scabbard. A knife blade sharpener means is permanently mounted on the scabbard and, in one embodiment, comprises a blade-receiving sharpening slot extending transversely through the scabbard and passage therein. The slot is formed by aligned holes in two opposite side walls of the scabbard. The sharpener means further comprises sharpening elements in the form of a pair of cylindrically shaped and angularly arranged ceramic abrasive elements which are permanently attached to the outside of one wall of the scabbard and overlap a portion of the sharpening slot. A V-shaped groove defined by the sharpening elements makes sliding engagement with the edge of the blade of a knife which has been removed from the scabbard, inserted in the sharpening slot and then reciprocably moved in the slot to effect blade sharpening.

SUMMARY OF THE INVENTION

In accordance with the invention there is provided a scabbard for carrying a knife, such as is used by sportsmen for hunting or fishing, which scabbard is provided with a knife blade sharpener insert means for insertion in the scabbard. The scabbard may be provided with means such as a strap to enable it to be secured to clothing or gear worn by the user. The scabbard, which is fabricated of relatively flexible material such as, for example, pliant plastic, pliant leather or other material, comprises a pair of interconnected confronting spaced apart wall components defining an elongated blade-receiving passage open at one end for accommodating insertion and withdrawal of the blade of a knife to be carried and protected in the scabbard. The knife scabbard has a blade sharpening slot open at both ends extending laterally therethrough and transversely through the elongated blade-receiving passage. The knife blade sharpener insert means includes at least one insert member disposed in the elongated passage and includes a sharpening aperture in registry with the blade sharpening slot in the scabbard and further includes at least one blade sharpening element mounted on the insert member and overlies a portion of the aperture therethrough. The blade sharpening element makes sliding engagement with the edge of a knife blade being reciprocably moved in the sharpening slot and in the aligned aperture to effect sharpening. The axis along which the knife blade is reciprocably moved during sharpening is transverse to the longitudinal axis of the passage in the scabbard. The blade sharpening element is fabricated of material hard enough to sharpen the edge of a knife blade, such as abrasive stone, ceramic or even tool steel.

Preferably, two substantially identical face-to-face insert members and two blade sharpening elements in the form of cylindrical ceramic rods are provided. The knife blade slips between the insert members in normal use. The two rods are disposed in V-shaped arrangement relative to each other and located at (and overlapping) an end of the sharpening apertures and slot. The aperatures and slot are constructed and shaped so as to support the knife blade in desired positions during sharpening. In a sharpening operation, the knife blade is inserted into the sharpening slot and sharpening apertures and moved reciprocably therein at an appropriate angle relative to the sharpening elements so that the blade edge to be sharpened bears or wipes against the sharpening elements. Such movement is repeated until the desired degree of sharpness is attained.

A knife scabbard having a knife blade sharpener insert mounted therein in accordance with the invention offers several advantages over the prior art. For example, it provides a convenient and economical way to provide sharpening means within a conventional scabbard which only needs to be modified by provision of a transverse sharpening slot therethrough. Furthermore, since the blade sharpening means becomes, in effect, an integral part of the scabbard (although the insert members are removable if need be), the blade sharpening means are always at hand when needed and cannot be lost or displaced. The arrangement eliminates the need for a separate storage compartment or support for the blade sharpening means. The scabbard also serves as a convenient, safe and easily held holder for the blade sharpening means thereon when a knife is being sharpened.

The location, configuration, arrangement and construction of the sharpening slot on the scabbard and on the insert member and the associated blade sharpening elements ensure that the knife blade assumes the correct angular position relative to the abrasive means as the blade is moved or drawn through a sharpening stroke.

Other objects and advantages of the invention will hereinafter appear.

DRAWINGS

DESCRIPTION OF A PREFERRED EMBODIMENT

Figure 1:
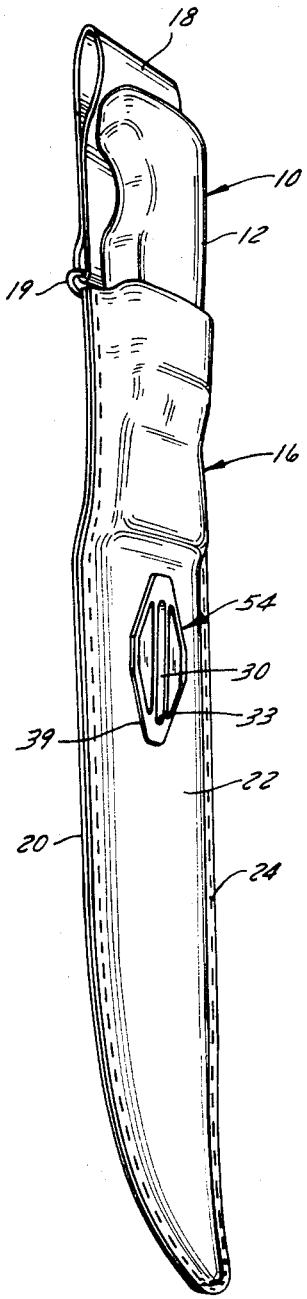
FIG. 1 is a perspective view of a knife scabbard having a blade sharpener insert means in accordance with the invention mounted therein and also having a knife inserted therein in storage position.
Figure 2:
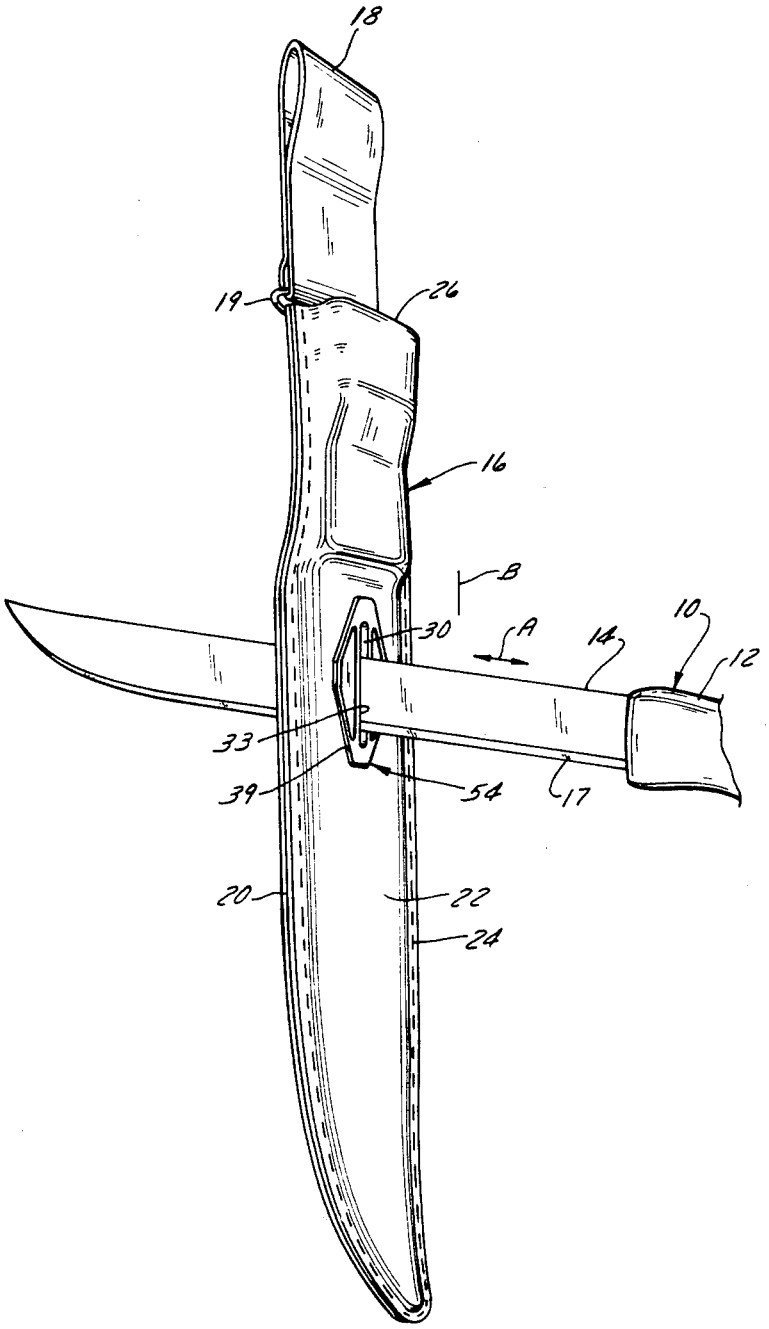
FIG. 2 is a view similar to FIG. 1 but showing the knife removed from storage position in the scabbard and inserted instead in sharpening position through transverse blade sharpening apertures in the blade sharpening insert.
Figure 7:
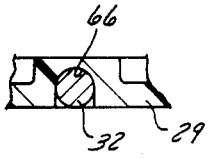
FIG. 7 is a cross-section view taken on line 7—7 of FIG. 4 of a blade sharpening element.
Figure 3:
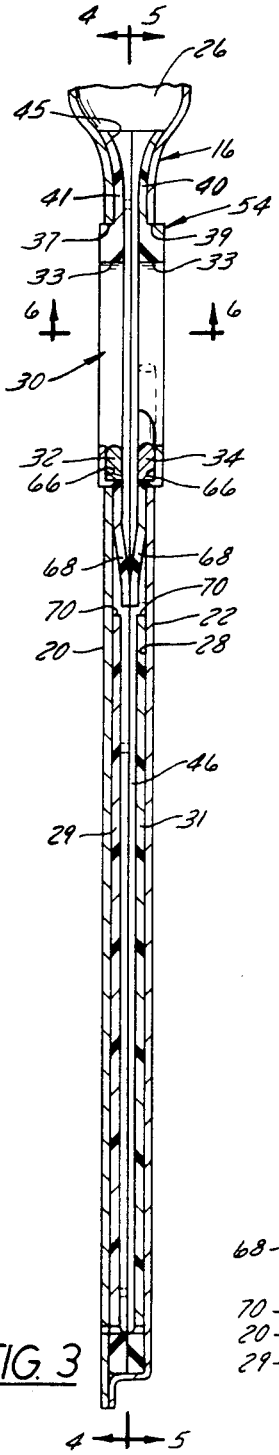
FIG. 3 is a cross-section view of the scabbard and blade sharpener insert means shown in FIGS. 1 and 2.
Figure 8:
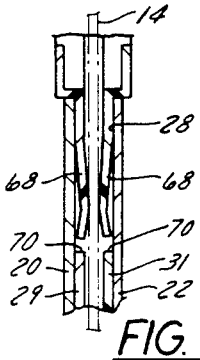
FIG. 8 is an enlarged cross-section view of a portion of the scabbard and the components of the sharpener insert means shown in FIG. 7 but showing a knife blade in storage position between the components.

Referring to FIGS. 1 and 2, the numeral 10 designates a knife, comprising a handle 12 and a blade 14 having an edge 17, which is disposed in a scabbard 16. Scabbard 16 is shown as having a belt-loop 18 secured thereon as by a ring 19, but it is to be understood that the belt-loop 18 could be omitted or, if preferred, other types of means or devices (not shown) could be provided to enable attachment of the scabbard to clothing or gear worn by a user or on the user himself. Scabbard 16 is formed of pliant material such as leather and comprises spaced apart side walls 20 and 22 which are joined or interconnected along their edges by stitching 24. If preferred, however, scabbard 16 could be fabricated of other pliant materials, besides leather, and constructed in some other fashion. For convenience, walls 20 and 22 may be considered as inner and outer walls, respectively, in consideration of their positions when the scabbard 16 is being worn by a user. As FIGS. 3 and 8 show, confronting spaced-apart side walls 20 and 22 and their edges cooperate to define an elongated blade-receiving passage 28 open at one end 26 for accommodating the insertion and withdrawal of the entire blade 14 and a portion of handle 12 when knife 10 is placed or inserted for storage in scabbard 16. Scabbard 16 is shaped so that passage 28 is relatively narrow at its lower portion to more closely conform to the shape of knife blade 14 and is relatively wide at its upper portion to accommodate and frictionally engage a portion of knife handle 12, such frictional engagement aiding in preventing accidental dislodgment of knife 10 from scabbard 16.

In accordance with the invention, scabbard 16 is provided with knife blade sharpening means mounted therein. As FIGS. 1, 2 and 3 show, the knife blade sharpening means generally comprise a blade-receiving sharpening slot, generally designated 30, formed in a portion of the scabbard 16 and knife blade sharpener insert means. The knife blade sharpener means includes a pair of insert members or components 29 and 31 disposed in passage 28, each component including an aperture 33 in registry with blade sharpening slot 30. The insert means further includes at least one blade sharpening element 32 or 34 mounted on an insert member 29 or 31, respectively, and overlying a portion of an aperture 33 in the insert member.

As FIGS. 1, 3 and 8 show, the slot 30 is defined by the two aligned holes 37 and 39 in the scabbard walls 20 and 22, respectively, and by the passage 28 therebetween inside the scabbard 16. As FIG. 2 shows, the slot 30 has an axis A transverse to the longitudinal axis B of the scabbard 16. In other words, the axis A along which the knife blade 14 is reciprocably moved during sharpening is transverse to the longitudinal axis B of the passage 28 in the scabbard 16.

Figure 6:
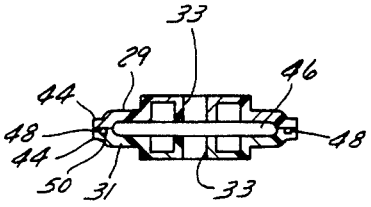
FIG. 6 is a cross-section view taken on line 6—6 of FIG. 3 of the mating components of the sharpener insert means.
Figure 4:
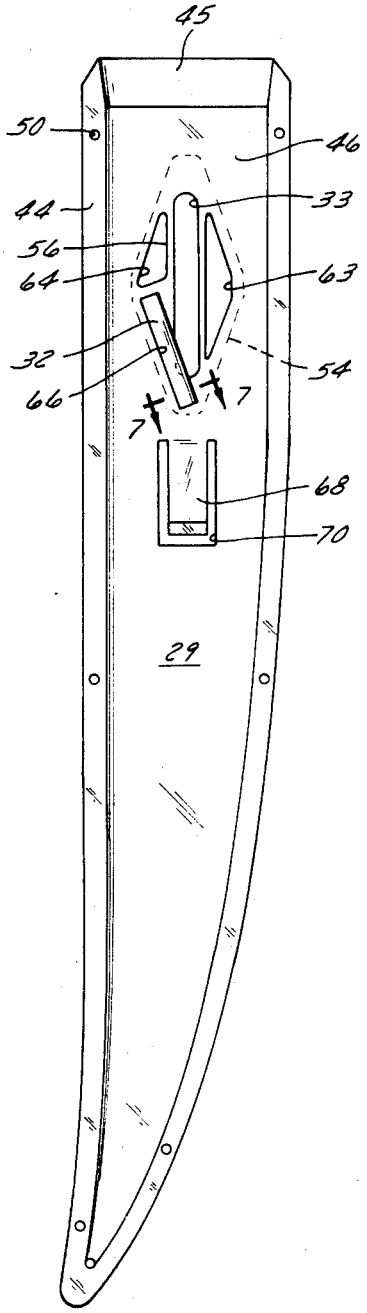
FIG. 4 is an elevation view taken on line 4—4 of FIG. 3 of the inside surface of one of a pair of mating components comprising the sharpener insert means and showing one of a pair of blade sharpening elements mounted thereon.
Figure 5:
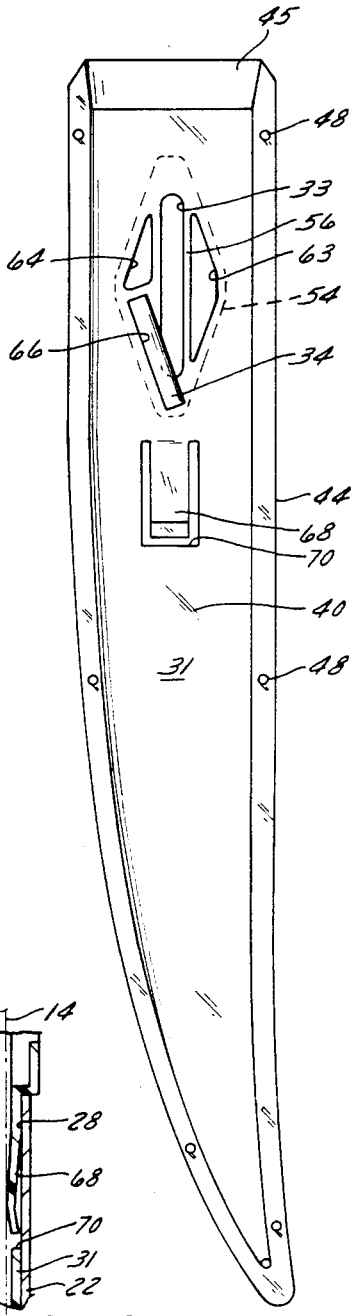
FIG. 5 is an elevation view similar to FIG. 4 taken on line 5—5 of FIG. 3 but showing the other mating component of the pair and the other blade sharpening element of the pair.
Figure 9:
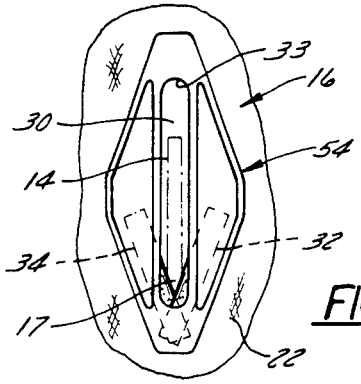
FIG. 9 is an enlarged side elevation view of a portion of the scabbard and showing a portion of the sharpener insert therein.
Figure 10:
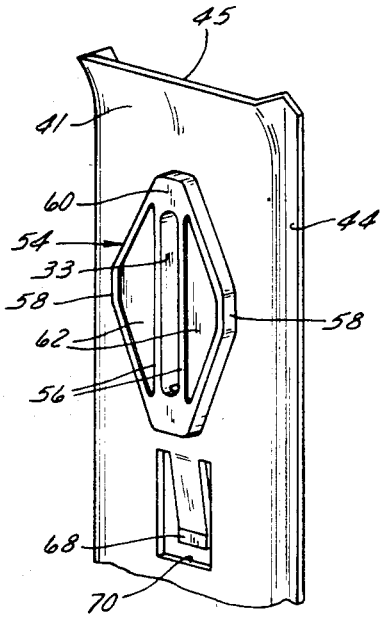
FIG. 10 is an enlarged perspective view of a portion of the outside of the component system in FIG. 4.
Figure 11:
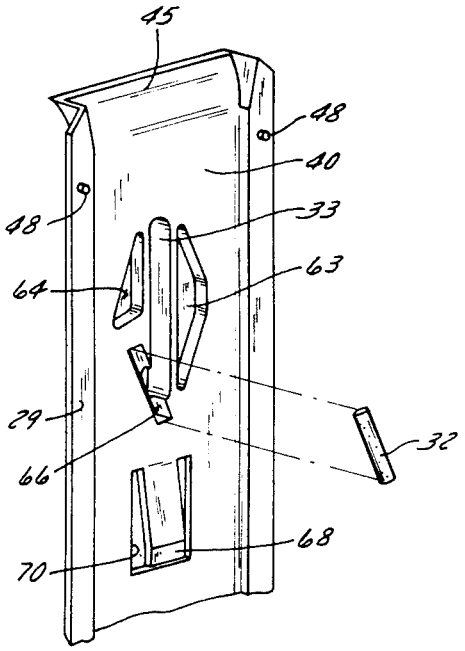
FIG. 11 is an exploded perspective view of the opposite side of the component shown in FIG. 10 and showing the sharpening element thereof.

The knife blade sharpener insert means comprises the insert members or components 29 and 31 which are shown separately in FIGS. 4 and 5, respectively, and are shown in confronting mating relationship inside passage 28 in scabbard 16 in FIGS. 3, 6 and 8. Since components 29 and 31 are substantially identical to each other in construction, except for being mirror images except as hereinafter explained, only component 29 is hereinafter described in detail. As FIGS. 4 through 10 show, component 29, which is fabricated by molding from fairly rigid plastic and conforms in outline and size to scabbard passage 28, comprises generally flat inside and outside surfaces 40 and 41, respectively, (compare FIGS. 10 and 11). Component 29 includes an integrally formed generally L-shaped peripheral flange 44 on or along all outer edges except its outwardly flared upper end edge 45. As FIG. 6 shows, the flanges 44 on components 29 and 31 extend toward each other when the components are in mating relationship so as to define a blade passage 46 therebetween. To ensure aligned mating of components 29 and 31, flange 44 of component 31 is provided with a plurality of integrally formed spaced apart alignment pins 48 which register with and are received within a plurality of corresponding spaced apart alignment pin holes 50 in flange 44 of component 29. Component 29 includes the aforementioned aperture 33 which is elongated in form and extends entirely through the component between the inner and outer surfaces 40 and 41, respectively. Aperture 33 is about half again as long as the width between edges of knife blade 14 and is about twice as wide as the thickness of the knife blade. When the components 29 and 31 are mated, the apertures 33 therein are in alignment with each other; and, when the mated components are inserted in passage 28 in scabbard 16, the aligned apertures 33 are within and aligned with the passage 30 through scabbard 16. Since the sides of the apertures 33 afford some support and guidance for knife blade 14 during sharpening, and since the distance between surfaces 40 and 41 of component 29 is relatively small, the aperture 33 is surrounded by a flange or integrally formed raised structure generally designated by numeral 54 and comprising, as FIG. 10 shows, a pair of inner ribs 56 and a pair of outer ribs 58, connected by a pair of end ribs 60 and webs 62. As FIG. 11 shows, the opposite side of structure 54 embodies two recesses 63 and 64, as well as a recess 66 for receiving and supporting sharpening element 32, as hereinafter explained. Component 29 also comprises an integrally formed tang 68 surrounded by a U-shaped cut-out 70 which extends from surface 40 toward the corresponding tang 68 in component 31. As FIG. 8 shows, the two tangs 68 frictionally and slidably engage opposite sides of knife blade 14 and operate to help maintain knife 10 in scabbard 16.

As previously stated, the knife blade sharpener insert means includes blade sharpening elements 32 and 34 which are mounted on the insert components 29 and 31, respectively. Referring to FIGS. 3, 4, 5, 7, 9 and 11, it is seen that the two blade sharpening elements 32 and 34 each take the form of a rigid cylindrical member fabricated of abrasive ceramic material. The members 32 and 34 are mounted at angles to one another in scabbard 16 by being entrapped and secured in the recesses or depressions 66 integrally formed as by molding in the components 29 and 31 when the latter are inserted in scabbard 16. As FIG. 9 shows, the members 32 and 34 define a V-shaped or an acute angle, the corner of which overlies the lower end of slot 33 in components 29 and 31 so that when the knife blade 14 moves in the slot, its edge 17 can make contact with either or both sharpening members 32 or 34. Referring to FIG. 3, the members 32 and 34 are shown as lying in parallel spaced apart planes, and they are arranged so that one member 32 overlies or crosses the other member 34, as FIG. 9 shows, within the scabbard slot 30.

In operation, as FIGS. 2 and 9 show, the knife blade 14 is inserted through the slots 33 in scabbard slot 30 and moved reciprocably therein (see arrow A in FIG. 2) as the blade edge 17 to be sharpened bears against the blade sharpening members 32 and 34 adjacent the ends of the slots 33. Such movement continues until the desired degree of sharpness is attained.

We claim:

1. In combination:

a knife scabbard having an elongated passage open at one end for accommodating a blade of a knife carried in said scabbard and knife blade sharpening means for said scabbard comprising:

an opening extending transversely through said scabbard and through said passage therein;

insert means insertable into said passage and having a blade-sharpening slot extending therethrough and having a portion in registry with said opening in said scabbard;

and at least one blade-sharpening element mounted on said insert means and overlying a portion of said slot in said insert member for sliding engagement with a knife blade to be sharpened and inserted through said opening in said scabbard and through said blade-sharpening slot.

2. A combination according to claim 1 including a pair of blade-sharpening elements mounted on said insert means and angularly arranged relative to each other to define a groove overlying said portion of said slot.

3. A combination according to claim 2 wherein said insert means comprises a pair of insert components each having a blade-sharpening slot and arranged in confronting relationship so that said slots are in registry with each other;

and wherein each of said insert components supports one of said pair of blade-sharpening elements.

4. A combination according to claim 3 wherein at least one of said insert components includes a projection for sliding frictional engagement with a knife blade inserted into said passage in said sheath to aid in mounting a knife in said scabbard.

5. A combination according to claim 4 wherein each of said insert components includes a said projection.

6. A combination according to claim 1 wherein said insert means includes a recess in which said blade-sharpening element is mounted.

7. Knife blade sharpening means for insertion into an open-ended elongated blade-receiving passage of a knife scabbard, which scabbard is provided with an opening extending transversely therethrough and through said passage, said knife blade sharpening means comprising:

a pair of insert components for disposition in confronting relationship to each other with a space therebetween for accommodating a knife blade;

each of said components having a blade-sharpening slot extending therethrough, which slots register with each other when said components are in said confronting relationship;

each of said components further comprising a recess adjacent its associated blade-sharpening slot;

and a pair of blade-sharpening elements mounted on said pair of insert components;

each of said blade-sharpening elements disposed in a recess and overlying a portion of the slot in its associated insert component.

8. Knife blade sharpening means according to claim 7 wherein at least one of said insert components includes a projection for sliding frictional engagement with a knife blade.

9. Knife blade sharpening means according to claim 8 wherein each of said insert components includes a said projection.

* * * * *